US005108269A

United States Patent [19]

Glanvall

[11] Patent Number: 5,108,269

[45] Date of Patent: Apr. 28, 1992

[54] METHOD OF CONTROLLING A ROTARY COMPRESSOR

[75] Inventor: Rune V. Glanvall, Norrköping, Sweden

[73] Assignee: Stal Refrigeration AB, Norrköping, Sweden

[21] Appl. No.: 375,452

[22] Filed: Jul. 5, 1989

Related U.S. Application Data

[63] Continuation-in-part of Ser. No. 297,403, Jan. 17, 1989, which is a continuation of Ser. No. 8,163, Jan. 29, 1987, abandoned.

[30] Foreign Application Priority Data

Jan. 31, 1986 [SE] Sweden ..... 8600424

[51] Int. Cl.[5] ..... F04C 18/16

[52] U.S. Cl. ..... 417/310; 418/201.2; 418/1

[58] Field of Search ..... 417/310, 302; 418/201 A, 1

[56] References Cited

U.S. PATENT DOCUMENTS

| | | | |
|---|---|---|---|
| 3,088,658 | 5/1963 | Wagenius | 418/201 A |
| 3,088,659 | 5/1963 | Nilsson et al. | 418/201 A |
| 3,151,806 | 10/1964 | Whitfield | 418/201 A |
| 3,936,239 | 2/1976 | Shaw | 418/201 A |
| 4,042,310 | 8/1977 | Schibbye et al. | 418/201 A |
| 4,498,849 | 2/1985 | Schibbye et al. | 417/299 |
| 4,737,082 | 4/1988 | Glanvall | 417/310 |
| 4,877,380 | 10/1989 | Glanvall | 417/310 |
| 4,878,818 | 11/1989 | Shaw | 417/310 |
| 4,932,844 | 6/1990 | Glanvall | 417/309 |

*Primary Examiner*—Richard A. Bertsch
*Assistant Examiner*—David L. Cavanaugh
*Attorney, Agent, or Firm*—Watson, Cole, Grindle & Watson

[57] ABSTRACT

Lift valves are used for controlling the capacity of a rotary compressor and to vary the built-in volume in the rotary compressor. When controlling the capacity of the rotary compressor, the built-in volume is adjusted by controlling the opening and closing of the lift valves in relation to one another.

7 Claims, 7 Drawing Sheets

METHOD OF CONTROLLING A ROTARY COMPRESSOR

CROSS-REFERENCE TO RELATED APPLICATION

The present application is a continuation-in-part application of application Ser. No. 297,403, filed Jan. 17, 1989 pending, which was a continuation of application Ser. No. 008,163, filed Jan. 29, 1987, now abandoned.

FIELD OF THE INVENTION

The present invention relates to rotary screw compressor equipment for use in a refrigeration or heat pump system and to a method for controlling such a system.

BACKGROUND OF THE INVENTION

The capacity of rotary compressors of various types is usually controlled by an axially or tangentially displaceable sliding valve opening one or more counterflow channels between the operating chamber and the inlet side of the compressor. Such an arrangement is shown in FIG. 1 which shows a section through a screw compressor of the SRM type, also known as a Lysholm or twin-screw compressor. In principle, the same control system is used in the Globoid compressor.

The rotary compressor in FIG. 1 comprises an operating chamber 1 with rotors, an axially displaceable slide 2 which also forms an outlet gate 6, the inlet side 3 and outlet side 4 of the compressor, and a counterflow gate 5. The counterflow gate communicates with the inlet side of the compressor and its size is determined by the displacement of the slide 2.

Rotary compressors of the type mentioned are displacement compressors with no operating valves in the inlet or outlet gates. For optimal efficiency an internal compression occurs in the operating chamber when the inlet has been closed and before the outlet is opened. FIGS. 2*a, b* and *c* show the axial built-in volume variation and the position of the sliding valve when the counterflow channel is closed and when it is displaced towards the outlet plane. The following equation is applicable for optimal efficiency:

$$\frac{P2}{P1} = \left(\frac{V1}{V2}\right)^n,$$

see FIG. 3.

P2 is the outlet pressure, P1 is the inlet pressure, V1 is the maximum volume, V2 is the operating volume immediately before the outlet gate is opened and n is the polytrophic exponent.

The above designations are also applicable to the full-load case shown in FIG. 2*b*, that is when the counterflow channel is completely closed. At a drop in the capacity requirement, the sliding valve is displaced towards the outlet plane, FIG. 2*c*, and the situation aimed at for optimal operation corresponds to $$\frac{P2}{P1} = \left(\frac{V3}{V4}\right)^n$$

It can be seen from FIG. 2*c* that when the sliding valve is displaced towards the outlet plane the discharge gate will become smaller, which in this case results in the volume V4<V2 and that the volume withdrawn V3<V1. In this manner the above optimum ratio between pressure and volume may be maintained.

U.S. Pat. No. 3,088,658 (Wagenius) describes a rotary compressor with a rotating valve for control of capacity and volume ratio. This comprsessor is of a complex mechanical design with valve housings on one or both sides of the operating chamber and with complex curved shapes of the rotating valve or valves, requiring accurate and expensive machining operations. The rotating valves will require complicated closed loop control systems for their accurate positioning. Further, any adjustment of the compressor capacity will involve accurate positioning of mechanical masses and will therefore be slow unless complicated, powerful and expensive control systems are provided. Also the location and size of the various ports in the wall of the operating chamber is restricted by the necessity of the ports communicating with the valve housing.

U.S. Pat. No. 4,042,310 (Schibbye) discloses a rotary compressor with a sliding or rotary valve for capacity control. This compressor has the same disadvantages as the compressor described in the above-mentioned Wagenius patent.

Japanese Patent Publication 59-131 791 (Toyoda Jido Shokki Seisakusho K.K.) discloses a rotary compressor with lift valves for capacity control.

In a compressor with capacity control by means of counterflow gates, the built-in volume ratio will vary when the capacity is varied, resulting in a non-optimal pressure ratio and consequent power losses. These losses are particularly high in a compressor for use in a refrigeration system or in a heat pump system due to the high density of the fluid media used in such plants.

SUMMARY OF THE INVENTION

It is an object of the invention to maintain, in a rotary compressor with capacity control by means of controllable counterflow ports, a desired optimum value of the built-in volume ratio of the compressor irrespective of capacity variations, and thereby a minimum of power losses in the compressor. It is a further object of the invention to obtain this in a compressor which has a mechanically simple design, and which is easy and therefore inexpensive to manufacture. It is a still further object to obtain this through the use of control means which are simple, inexpensive, rugged and reliable.

These advantages are obtained through the invention by providing a rotary screw compressor for use in a heat pump system or in a refrigeration system, and having an operating chamber, with at least one counterflow gate positioned in a wall of the operating chamber and a first radially oriented lift valve for said gate, at least one discharge gate positioned in a wall of the operating chamber and a second radially oriented lift valve for said discharge gate, and control means for moving said first lift valve to open said counterflow gate for reduction of the capacity of said compressor and for moving, substantially simultaneously therewith, said second lift valve to close said discharge gate for increasing the built-in volume of said compressor.

DESCRIPTION OF THE PREFERRED EMBODIMENT

Figure 4A:
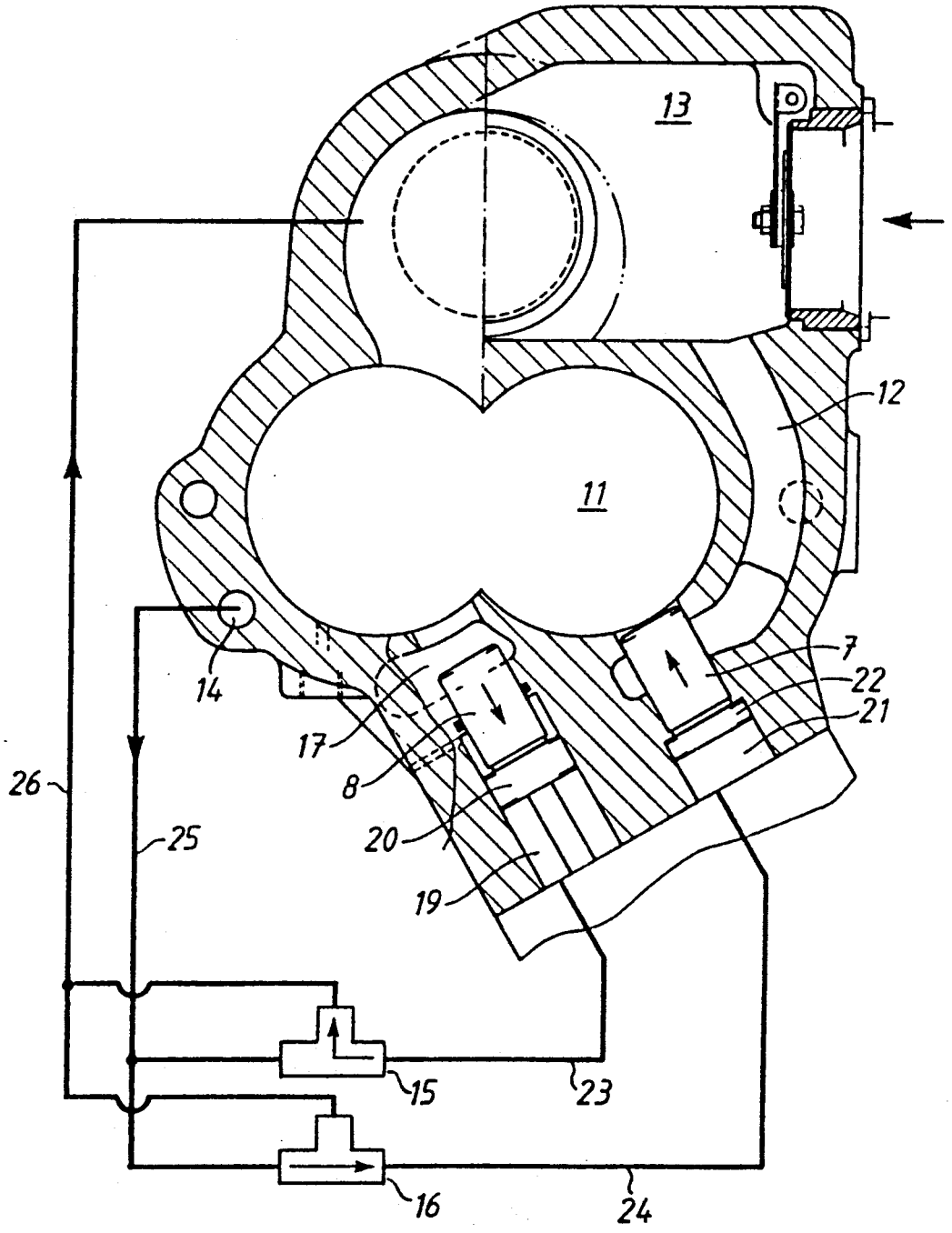
FIG. 4 shows a section through a rotary compressor with lift valves, and a system for control of the valves.
Figure 4B:
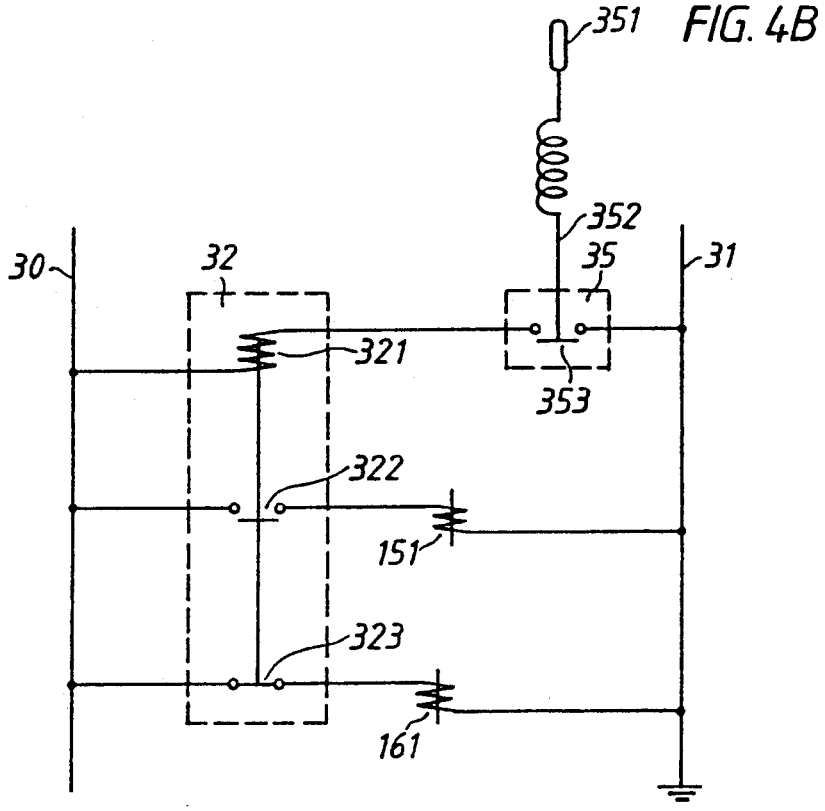
Figure 4D:
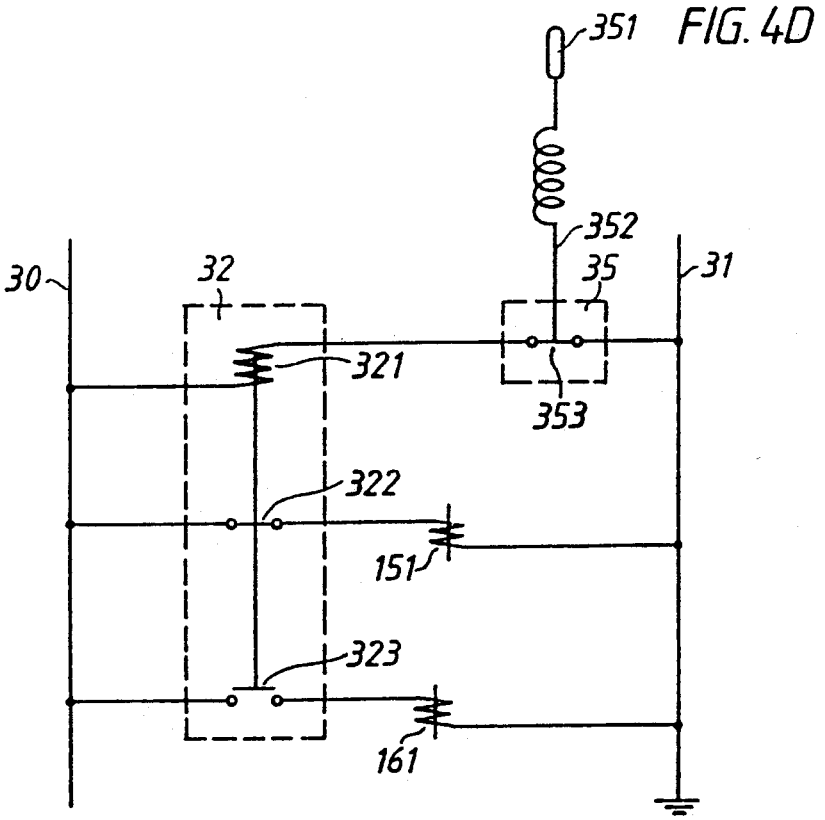
Figure 4C:
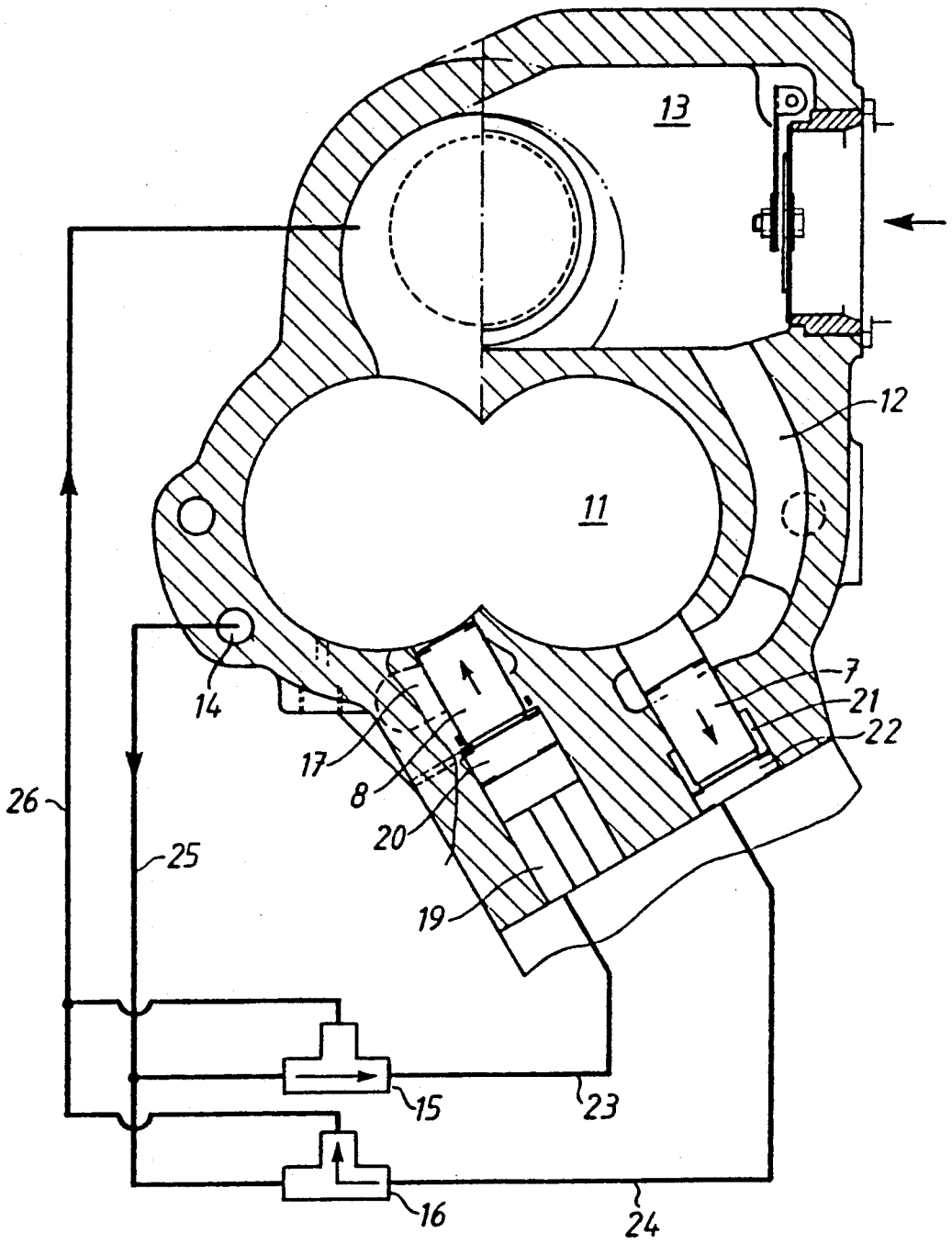

FIGS. 4*a* through 4*d* show a rotary compressor according to the present invention together with its control system for actuation of the lift valves. FIGS. 4*a* and 4*b* show the compressor and control system in the case when the compressor is controlled to full capacity. FIGS. 4*c* and 4*d* show the case when the compressor is controlled to reduced capacity. FIGS. 4*a* and 4*c* show a section through the compressor. FIGS. 4*b* and 4*d* show the system for control of the lift valves.

FIGS. 4*a* and 4*c* show a section through the compressor with its operating chamber 11 for the rotors (the rotors are not shown). On its inlet (low pressure) side the compressor has an inlet manifold 13. A channel 12 connects the inlet manifold 13 with the capacity control valve 7 in such a way that, when valve 7 is in its open position, the operating chamber is connected to the inlet manifold through channel 12. A channel 17 connects the outlet (high pressure) side of the compressor to the lift valve 8 for control of the built-in volume in such a way that, when valve 8 is in its open position, the operating chamber is connected to the compressor outlet side through channel 17. The position of valve 7 is controlled by means of an operating piston 22 travelling in a cylinder 21. In the same manner the position of valve 8 is controlled by means of a piston 20 travelling in a cylinder 19. The cylinders 19 and 21 are connected to two-way solenoid valves 15 and 16 through tubes or conduits 23 and 24, respectively. The tube 23, and hence the cylinder 19, is connected to the inlet (low pressure) side of the compressor through a tube 26 when valve 15 is deenergized, and to the outlet (high pressure) side of the compressor through a tube 25 and a conduit 14 in the compressor body when valve 15 is energized. The tube 24, and hence the cylinder 21, is connected to the inlet side of the compressor through tube 26 when valve 16 is deenergized, and to the outlet side of the compressor through tube 25 and conduit 14 when valve 16 is energized.

FIG. 4*a* shows the case with the compressor controlled to full capacity. Valve 15 is deenergized and connects cylinder 19 through tubes 23 and 26 to the low pressure side of the compressor, causing valve 8 to be opened by the differential pressure acting on piston 20. Valve 16 is energized and connects cylinder 21 to the high pressure side of the compressor through tubes 24, 25 and conduit 14. The pressure from the high pressure side acting on piston 22 closes valve 7.

FIG. 4*b* shows the control system for controlling the valves 15 and 16 and thereby the positions of valves 7 and 8. A temperature transducer 35 has a sensing body 351 arranged to sense the temperature in a part of a plant, whose temperature is to be controlled by the compressor. The plant may, for instance, be a refrigeration system, the capacity of which, and thereby the temperature in the refrigerated compartment, is controlled by controlling the capacity of the compressor. The sensing body 351 is then arranged in the refrigerated compartment. The sensing body comprises a suitable fluid, the pressure of which is influenced by the temperature of the sensing body. The latter is connected to the transducer itself by a capillary tube 352, and the pressure of this fluid acts upon the contacts 353 of the transducer so as to open the contacts when the sensed temperature (and therefore the pressure of the fluid) exceeds a predetermined value, and to close the contacts when the sensed temperature is below this predetermined value. In FIG. 4*b* the sensed temperature is assumed to be above the predetermined value, causing the contacts 353 to be opened. The contacts are connected in series with the operating coil of a relay 32 between a bus 30, connected to a suitable operating voltage, and a bus 31, connected to ground potential. The relay 32 has contacts 322 and 323, connected in series with the operation solenoids 151 and 161 of valves 15 and 16, respectively. In the case shown in FIG. 4*b* relay 32 is deenergized and its contacts 322 open and its contacts 323 closed. Valve 15 is thus deenergized and valve 16 energized, causing the capacity control valve 7 to be closed for full capacity operation of the compressor and the built-in volume control valve 8 to be opened for a reduction of the built-in volume ratio of the compressor.

If the temperature in the refrigerated compartment sinks below its predetermined value, the contacts 353 of the temperature transducer are closed as shown in FIG. 4*d*, causing the energization of relay 32 and of valve 15 and the deenergization of valve 16. As shown in FIG. 4*c*, the deenergization of valve 16 causes cylinder 21 to become connected to the compressor low pressure side, whereby valve 7 is opened, causing a reduction of the compressor capacity. At the same time, the energization of valve 15 causes cylinder 19 to become connected to the compressor high pressure side, causing the valve 8 to be closed for an increase of the built-in volume ratio of the compressor.

Figure 1:
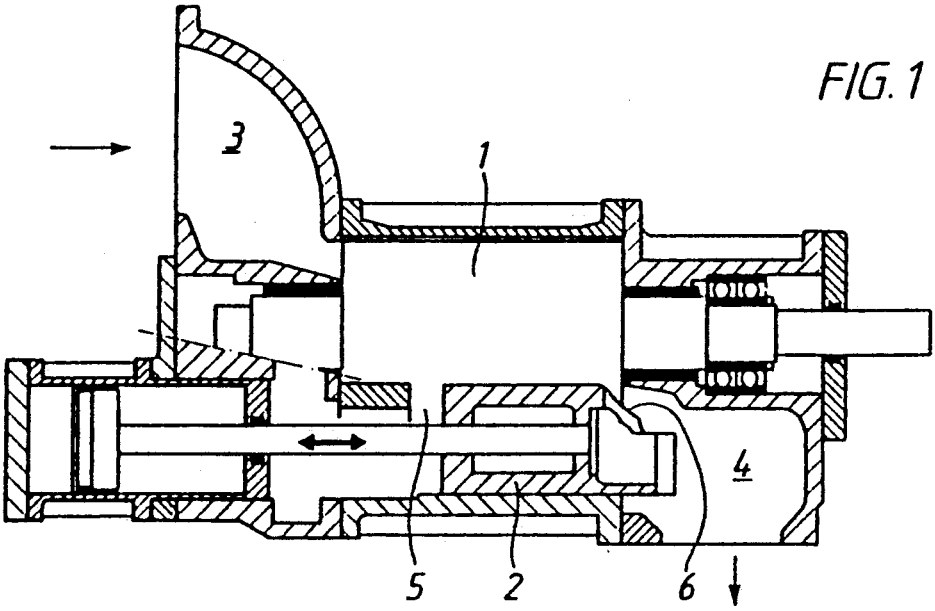
FIG. 1 shows a section through a rotary compressor.
Figure 5:
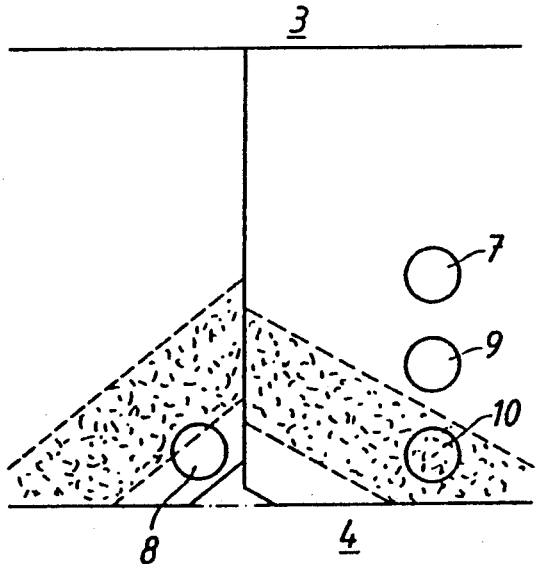
(PRIOR ART) FIG. 5
FIG. 5 shows how several lift valves are arranged between the inlet and outlet sides.
Figure 2A:
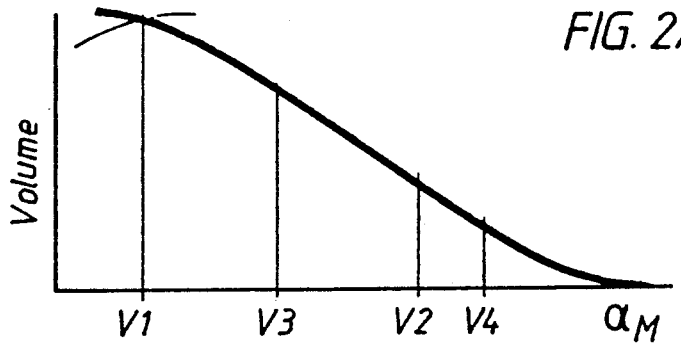
FIG. 2*a* shows the volume variation axially in the rotary compressor.
Figure 2B:
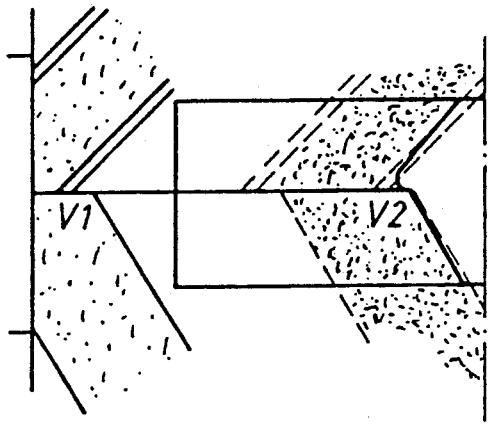
FIGS. 2*b, c* show the position of the sliding valve with the counterflow channel fully closed and with the sliding valve displaced towards the outlet plane.
Figure 2C:
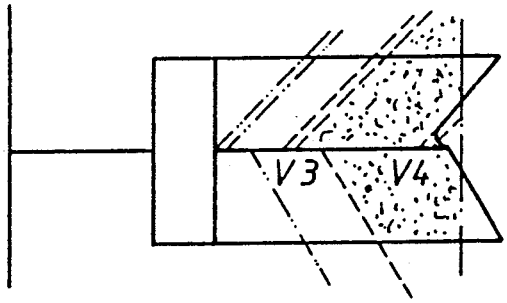
Figure 3:
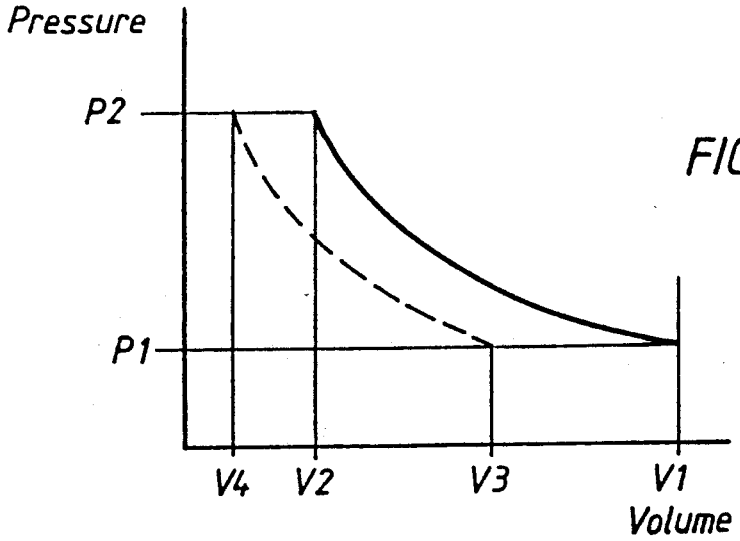
FIG. 3 shows the ratio between pressure and volume in the rotary compressor.

In the manner described above, a change in the compressor capacity is accompanied by a simultaneous adjustment of the built-in volume ratio of the compressor. For instance, an opening of valve 7 for a reduction of the compressor capacity is always accompanied by the closing of valve 8 for increasing the built-in volume ratio, and the closing of valve 7 for increasing the compressor capacity to its full value is always accompanied by an opening of valve 8 for decreasing the built-in volume ratio. In this manner an immediate adjustment of the volume ratio is obtained at each capacity change, and thus the volume ratio may be maintained at its optimum value with regard to the operating conditions of the compressor at all times, resulting in important reductions of the power losses of the compressor. In the preferred embodiment described above, there is only one such pair of simultaneously operated valves, namely the capacity control valve 7 and the volume control valve 8. These valves may be situated as shown in FIG. 5, which shows the folded-out wall of the operating chamber of the compressor in the same manner as in FIGS. 2*b* and 2*c*. In FIG. 5 two further capacity control valves 9 and 10 are shown. A first reduction of the compressor capacity is made by opening valve 7, a further reduction by opening valve 9, and a still further reduction by opening valve 10. In practice, it has often proved to be sufficient to accompany the first capacity reduction step (the opening/closing of valve 7) by a simultaneous adjustment of the volume ratio (by the closing/opening of valve 8). The increase in compressor efficiency to be attained by accompanying also the further capacity reduction stages by corresponding volume ratio adjustments are in the typical case smaller than the increase obtained with respect to the first capacity reduction stage. If desired, however, in order to obtain a more perfect adjustment of the volume ratio to the capacity, a plurality of volume control valves may be provided, each one cooperating with a corresponding capacity control valve in the same manner as described above with respect to valves 7 and 8. Each of the pairs of valves thus formed may be provided with a control system of the kind described above so that the opening/closing of a capacity control valve is always accompanied by the simultaneous closing/opening of the corresponding volume control valve. In a cooling plant of the kind described, there may then be provided a set of thermostats—or a single thermostat with a plurality of contacts—which successively opens the capacity control valves for stepwise reduction of the compressor capacity as the sensed temperature sinks below a predetermined value.

Figure 6A:
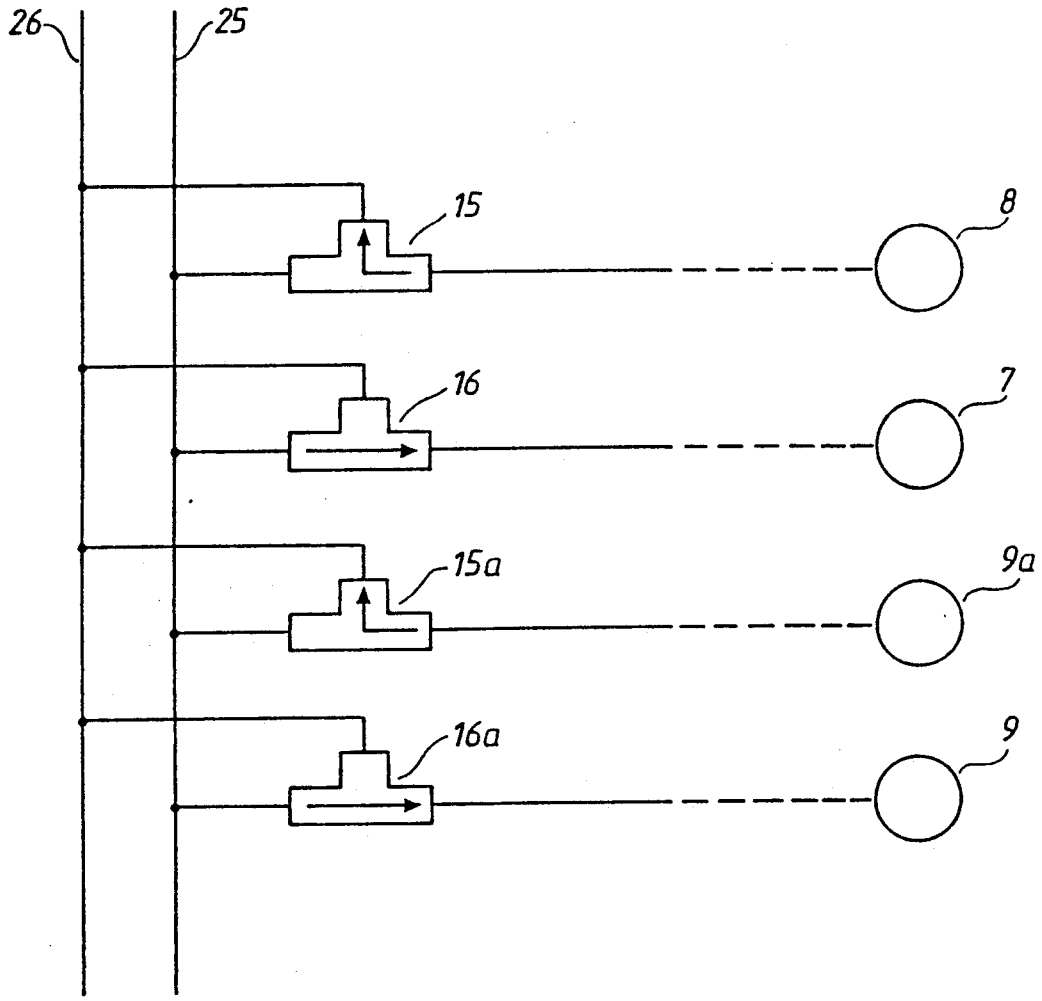
FIG. 6 shows a control system for a compressor with two pairs of simultaneously operated lift valves.
Figure 6B:
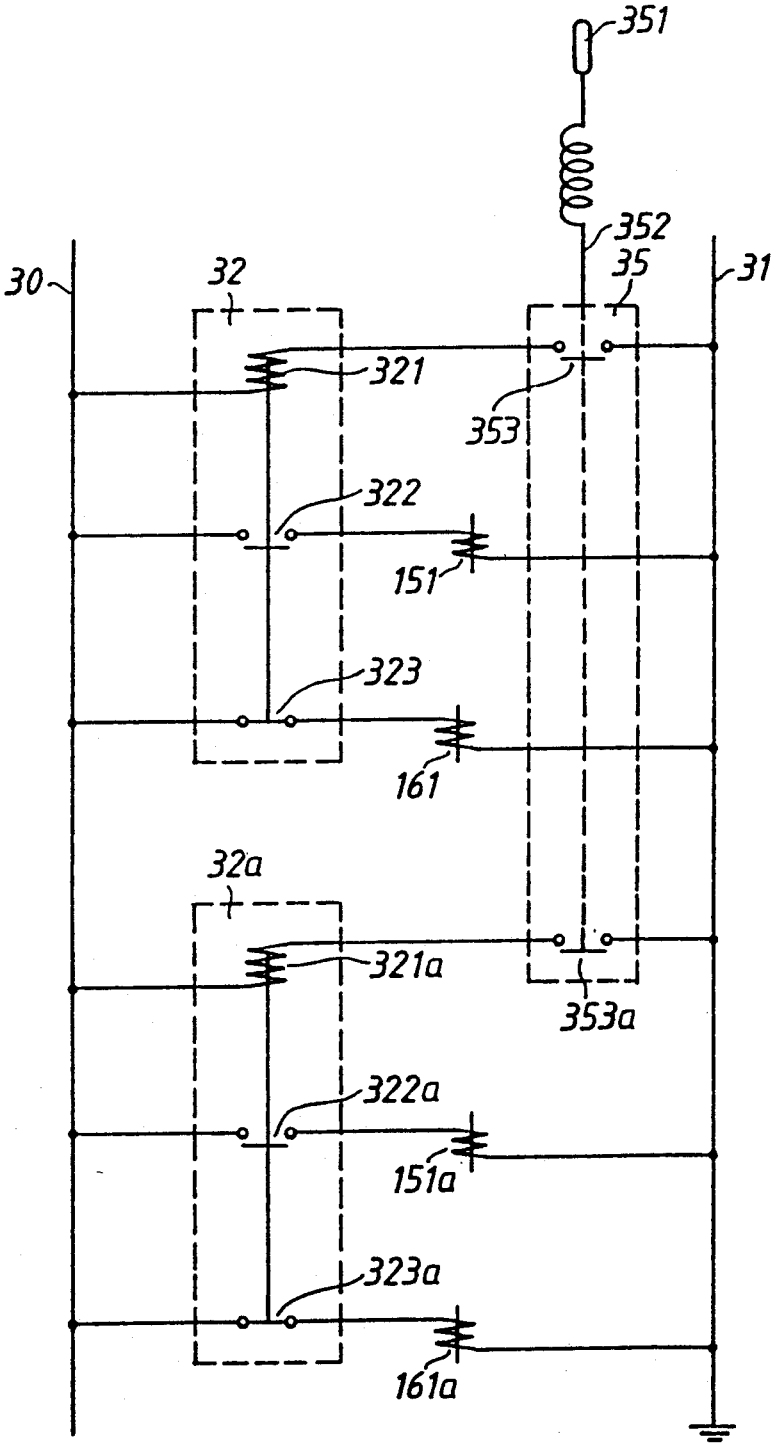

FIGS. 6*a* and 6*b* show a control system for a compressor with two pairs of simultaneously operated valves 7, 8, 9 and 9*a*. Valves 7 and 9 are capacity control valves and valves 8 and 9*a* valves for control of the built-in volume ratio. Valves 7, 8 and 9 are shown in FIG. 5. Valve 9*a* (not shown in FIG. 5) is arranged between valve 8 and the compressor outlet plane 4 in FIG. 5.

FIG. 6*a* shows the tubes 25 and 26, which are connected to the high pressure side and to the low pressure side, respectively, of the compressor. Solenoid valves 15 and 16 for control of valves 7 and 8 are connected and operate as described above in connection with FIG. 4. Two similar solenoid valves 15*a* and 16*a* are connected in the same manner as valves 15 and 16 for control of valves 9*a* and 9.

FIG. 6*b* shows a temperature transducer 35 of the kind described above, which controls the operation of valves 7 and 8 through the auxiliary relay 32 and valves 15 and 16 in the manner described above in connection with FIG. 4.

The transducer 35 has a further contact 353*a*. The two contacts 353 and 353*a* are arranged to operate at different predetermined temperatures. FIG. 6*b* shows the position of the contacts when the sensed temperature is above a first predetermined value t1. Both contacts of the transducer are open. If the temperature sinks below t1, contact 353 closes with contact 353*a* still open. If the temperature sinks still further below a predetermined value t2, lower than t1, also contact 353*a* is closed.

Contact 353*a* is connected to an auxiliary relay 32*a* with operating coil 321*a* and contacts 322*a* and 323*a*. Connected in series with the solenoids 151*a* and 161*a* of valves 15*a* and 16*a*, respectively, between the supply voltage bus 30 and ground bus 31.

As already stated, FIGS. 6*a* and 6*b* show the case when the sensed temperature is above t1. Relays 32 and 32*a* are deenergized. Valves 16 and 16*a* are energized and therefore the capacity control lift valves 7 and 9 are closed, and the compressor works at full capacity. Valves 15 and 16 are deenergized and therefore the volume ratio control lift valves 8 and 9 are open.

If the sensed temperature sinks below t1, contact 353 will close, causing the energization of relay 32 and thereby the opening of lift valve 7 for a reduction of the compressor capacity and the closing of lift 8 for an increase of the volume ratio in the manner described above in connection with FIG. 4.

If the temperature sinks still further, below t2, also contact 353*a* will close, energizing relay 32*a*. This will cause the opening of lift valve 9 for a still further reduction of the compressor capacity and the closing of lift valve 9*a* for a still further increase of the compressor volume ratio.

If the temperature again rises, the process described above will be reversed, with a stepwise increase of compressor capacity as the temperature rises, accompanied by simultaneous stepwise reductions of the built-in volume ratio.

As described above, the capacity of the compressor is controlled stepwise by means of one or more lift valves. This capacity control may be made in as many and as small steps as desired by providing the desired number of successively operated capacity control lift valves.

The application mentioned above —a refrigeration plant —is only one example, and the invention may with advantage be applied also to, for instance, a compressor in a heat pump plant.

In the system described above the compressor is controlled by sensing the temperature in a relevant part of the plant of which the compressor is a part. The plant and compressor may, of course, be controlled with respect to any desired quantity, for instance the pressure, in a relevant part of the plant, in which the temperature transducer 35 described above is replaced by another suitable sensor.

While the embodiment described above is a preferred embodiment of the invention, many variations of the design of, for instance, the compressor itself, its lift valves and their control systemsare possible within the scope of the invention.

I claim:

1. A rotary screw compressor system for use in a refrigeration or heat pump system, comprising a rotary screw compressor having an operating chamber, a first lift valve for a counterflow gate movably positioned in a wall surrounding said operating chamber and radially oriented relative to said operating chamber, a second lift valve for a discharge gate movably positioned in said wall surrounding said operating chamber and radially oriented relative to said operating chamber, said counterflow and discharge gates being spaced apart from one another and at least said counterflow gate being positioned apart from an inlet and an outlet of the compressor, each of said first and second lift valves comprising a valve body movable radially inwards to a first position when said valve body closes its corresponding gate, and radially outwards to a second position when said valve body opens said gate, said valve body having at its radially outer end a piston movable in a cylinder, said compressor further including means for fluidly connecting the cylinder space radially outwards of the piston of each lift valve selectively to the outlet side of the compressor for closing the gate, or to the inlet side of the compressor for opening the gate, control means connected to said first and second lift valves for moving each of said lift valves to either close or open the gate associated with the valve, said control means comprising means for connecting the cylinder space outside of the piston of said first lift valve to the inlet side of the compressor to open said counterflow gate for reducing the capacity of said compressor, and, substantially simultaneously therewith, for connecting the cylinder space outside the piston of said second lift valve to the outlet side of the compressor to close said discharge gate, thereby increasing the built-in volume to adjust said built-in volume ratio to the reduced capacity.

2. A rotary screw compressor equipment as claimed in claim 1, said control means further comprising means for moving said first lift valve to close said counterflow gate for increasing the capacity of said compressor and, substantially simultaneously therewith, to move said second lift valve to open said discharge gate, thereby reducing the built-in volume to adjust said built-in volume to the increased capacity.

3. A rotary screw compressor equipment as claimed in claim 1, said compressor having a plurality of first lift valves for a plurality of counterflow gates, said lift valves and their associated counterflow gates being arranged at successively increasing distances from the inlet plane of the compressor, said control means comprising means for stepwise reduction of the compressor capacity from full capacity by moving a first one of said plurality of first lift valves to open its associated counterflow gate, said first one of the plurality of first lift valves being the valve closest to the compressor inlet plane, and, substantially simultaneously therewith, to close said second lift valve, and thereafter successively to open the remainder of said first lift valves.

4. A rotary screw compressor equipment as claimed in claim 1, said compressor having a plurality of first lift valves for a plurality of counterflow gates and a plurality of second lift valves for a plurality of discharge gates, said control system comprising means for stepwise reduction of the compressor capacity by moving a first one of said plurality of first lift valves to open its associated counterflow gate and, substantially simultaneously therewith, to move a first one of said plurality of second lift valves to close its associated discharge gate, and thereafter, for further capacity reductions, successively to move the remainder of said plurality of first lift valves to open their associated counterflow gates and, substantially simultaneously with the opening of each of said first lift valves, to move one of the remainder of said plurality of second lift valves to close its associated discharge gate.

5. A rotary screw compressor as claimed in claim 4, said first lift valves and their associated counterflow gates being arranged at successively increasing distances from the inlet plane of the compressor, said second lift valves and their associated discharge gates being arranged at successively increasing distances from the inlet plane of the compressor, said control means comprising means for stepwise reduction of the capacity of the compressor by successively moving said first lift valves to open their associated counterflow gates in the order of increasing distance from the compressor inlet plane, and by moving said second lift valves to close their associated discharge gates in the order of increasing distance from the compressor inlet plane.

6. A method of controlling a rotary screw compressor in a refrigeration or heat pump system, said rotary screw compressor including an operating chamber, a first lift valve for a counterflow gate movably positioned in a wall surrounding said operating chamber and radially oriented relative to said operating chamber, and a second lift valve for a discharge gate movably positioned in said wall surrounding said operating chamber and radially oriented relative to said operating chamber, said counterflow and discharge gates being spaced apart from one another and at least said counterflow gate being positioned apart from an inlet and an outlet of the compressor, each of said first and second lift valves comprising a valve body movable radially inwards to a first position when said valve body closes its corresponding gate, and radially outwards to a second position when said valve body opens said gate, said valve body having at its radially outer end a piston movable in a cylinder, said compressor further including means for fluidly connecting the cylinder space radially outwards of the piston of each lift valve selectively to the outlet side of the compressor for closing the gate, or to the inlet side of the compressor for opening the gate, said method including the steps of connecting the cylinder space outside of the piston of said first lift valve to the inlet side of the compressor to open said counterflow gate and thereby reduce the capacity of said rotary screw compressor, and substantially simultaneously therewith, for adjusting the built-in volume ratio to the reduced capacity, connecting the cylinder space outside the piston of said second lift valve to the outlet side of the compressor to close said discharge gate and thereby increase the built-in volume ratio of said rotary screw compressor.

7. A method according to claim 1, wherein said rotary screw compressor includes a plurality of first lift valves for a plurality of counterflow gates and a plurality of second lift valves for a plurality of discharge gates, and wherein after a first one of said plurality of first lift valves is moved to open its associated counterflow gate and a first one of said plurality of second lift valves is moved to close its associated discharge gate, the remainder of said plurality of first lift valves are sequentially moved to open their associated counterflow gates while the remainder of said plurality of second lift valves are sequentially moved to close the associated discharge gates.

* * * * *